US007360343B1

(12) United States Patent
Spransy et al.

(10) Patent No.: US 7,360,343 B1
(45) Date of Patent: Apr. 22, 2008

(54) RAISED ACCESS FLOOR

(75) Inventors: Peter J. Spransy, Salt Lake City, UT (US); Don A. Kugath, Draper, UT (US); Ronald H. Bushman, Salt Lake City, UT (US)

(73) Assignee: Daw Technologies, Inc., Salt Lake City, UT (US)

( * ) Notice: Subject to any disclaimer, the term of this patent is extended or adjusted under 35 U.S.C. 154(b) by 168 days.

(21) Appl. No.: 10/431,352

(22) Filed: May 7, 2003

Related U.S. Application Data

(60) Provisional application No. 60/378,613, filed on May 7, 2002.

(51) Int. Cl.
*E04B 5/00* (2006.01)
*E04B 1/00* (2006.01)

(52) U.S. Cl. ..... 52/263; 52/578; 52/506.06; 52/480

(58) Field of Classification Search ..... 52/578, 52/506.01, 263, 480, 384–392
See application file for complete search history.

(56) References Cited

U.S. PATENT DOCUMENTS

| | | | | | |
|---|---|---|---|---|---|
| 2,956,652 | A | | 10/1960 | Liskey, Jr. | |
| 2,956,653 | A | | 10/1960 | Liskey, Jr. | |
| 3,150,748 | A | | 9/1964 | Liskey, Jr. | |
| 3,180,460 | A | | 4/1965 | Liskey, Jr. | |
| 3,918,222 | A | * | 11/1975 | Bahramian | 52/223.7 |
| 3,971,181 | A | * | 7/1976 | Zetlin | 52/263 |
| 4,745,715 | A | | 5/1988 | Harwicke et al. | |
| 4,825,603 | A | | 5/1989 | Hardwicke et al. | |
| 4,843,781 | A | | 7/1989 | Chase, III | |
| D306,350 | S | | 2/1990 | Hardwicke et al. | |
| 4,901,490 | A | | 2/1990 | Zinniel et al. | |
| 4,922,670 | A | | 5/1990 | Naka et al. | |
| 5,074,085 | A | | 12/1991 | Ueda | |
| 5,228,252 | A | | 7/1993 | Nehls | |
| 5,271,203 | A | * | 12/1993 | Nagle | 52/721.4 |
| 5,402,617 | A | | 4/1995 | Daw et al. | |
| 5,412,914 | A | * | 5/1995 | Daw et al. | 52/126.6 |
| 5,791,096 | A | * | 8/1998 | Chen | 52/126.6 |
| 6,065,264 | A | * | 5/2000 | Imler et al. | 52/589.1 |

(Continued)

OTHER PUBLICATIONS

Seidelhube Metal Products, Inc.; http://www.seidelhuber.com/toolbar.htm; Stainless Steel Grating; pp. 1-10; Hayward, CA.

*Primary Examiner*—Jeanette Chapman
(74) *Attorney, Agent, or Firm*—Madson & Austin

(57) ABSTRACT

A raised access floor has panels suspended by pedestals. Each panel may have a top surface and a frame extending around the top surface. Each panel may have extruded aluminum components including four edge members, two intermediate members, and a center member. Each edge member may have a frame portion with a box beam configuration. The frame portions can be press-fitted with corner members to provide the frame. Two edge members, the intermediate members, and the center member may have top surface portions coupled together to form the top surface. The top surface may be supported by support ribs with enlarged bottom ends that resist bending. The ends of the support ribs are press-fitted against the frame. Components may be modified or removed to alter the panel geometry. A cover plate may be used to cover the top surface. The cover plate and/or top surface may be continuous or perforated.

4 Claims, 5 Drawing Sheets

U.S. PATENT DOCUMENTS 6,101,768 A 8/2000 Springstead et al.
6,155,013 A 12/2000 Kim
6,256,952 B1 7/2001 Fahy, Jr. et al.
6,354,483 B1 * 3/2002 Ezumi et al. ..... 228/112.1
6,413,610 B1 * 7/2002 Nakamura et al. ..... 428/98
6,519,902 B1 * 2/2003 Scissom ..... 52/126.4

* cited by examiner

RAISED ACCESS FLOOR

RELATED APPLICATIONS

This application claims the benefit of U.S. Provisional Application No. 60/378,613 filed May 7, 2002 and entitled EXTRUDED ALUMINUM RAISED ACCESS FLOOR, which is incorporated herein by reference.

BACKGROUND OF THE INVENTION

1. Field of the Invention

The present invention relates to flooring systems and methods. More specifically, the present invention relates to a raised access floor having removable panels with a high strength-to-weight ratio.

2. Description of Related Art

There are a wide variety of environments in which it may be desirable to store items such as fluid conduits, electrical wiring, machinery, or the like underneath a floor. Hence, many offices and manufacturing facilities use a dual flooring system, in which a raised access floor is suspended above a support surface. The raised access floor may have a pattern of removable tiles or panels that permit relatively easy access to the items between the support surface and the raised access floor.

Known raised access floors are limited in a number of respects. For example, many raised access floors have comparatively low limitations regarding how much weight can be disposed over each panel. Thus, relatively heavy equipment cannot be stored without using a heavy duty panel. Heavy duty panels may be formed of die cast steel or the like, and are typically quite heavy. Consequently, they are difficult to lift for removal or replacement, and thus impede access to the space underneath the raised access floor. Some heavy duty panels are still unable to provide a sufficient load bearing capacity without exceeding OSHA standards for weights to be lifted manually.

Furthermore, many known panels for raised access floors are subject to brittle failure. Such panels may show little strain until failure; thus, failure is catastrophic and occurs without warning. Brittleness also provides a panel with a comparatively low toughness, or impact strength. Thus, if a relatively heavy object is dropped onto the panel, breakage or weakening of the panel may result.

Furthermore, many known panels can only be produced in one size and shape. Use of die casting or similar manufacturing methods provides a shape that cannot easily be modified without compromising the structural integrity of the shape. Consequently, panels of odd sizes or panels with openings to provide wire or conduit passage, or the like, cannot easily be made, and, if cut from an existing cast panel, may not be sturdy enough for use in the environment.

Yet further, many known panels require enormous fixed costs to produce. A die cast raised access floor panel, for example, may require an initial investment of more than half a million dollars for fabrication of the die and related equipment. The die cannot readily be modified; hence, any alterations to the design of the panel will likely require a capital expenditure of the same magnitude.

Additionally, many known raised access floor systems require the fabrication and installation of a metal framework to support the panels. This is because some panels do not have sufficient edge strength to prevent deformation at the junctures between the panels. Consequently, each panel edge must be supported by a beam, or "stringer." This also raises the cost and installation difficulty of the raised access floor, and severely impedes access to the space underneath the raised access floor because the framework is not removable. Thus, anything that passes through the raised access floor must be able to fit through an area smaller than that of a single panel. This may make replacement or installation of certain types of equipment impossible underneath the raised access floor.

Moreover, some raised access floor panel designs have multiple parts that are not well-assembled. In some instances, the raised access floor panel may be loaded in such a manner that assembled parts will tend to loosen over time, thereby compromising the design of the panel. In other instances, attachment of parts of the panel is excessively reliant upon relatively labor intensive and/or unpredictable attachment methods such as welding.

Still further, some raised access floor panel designs have structural parts that do not line up flush with each other on the top surface. Hence, a cover such as a vinyl plate must be installed on the top of the panel. Unfortunately, such covers may disrupt the panel's ability to serve as a grounding member to dissipate undesirable electric potential, such as static electricity.

Accordingly, it would be an advancement in the art to provide a raised access floor with panels that have a high strength-to-weight ratio, high impact strength, and a low tendency to disassemble under loading. It would also be an advancement in the art to provide raised access floor panels that can be fabricated with a relatively low fixed cost to permit easy adaptation of panel designs to provide panels of different sizes or panels with openings for component pass-through. Yet further, it would be an advancement in the art to provide a raised access floor panel that does not require the installation of a support framework or a nonconductive cover layer. Still further, it would be an advancement in the art to provide a raised access floor panel that is inexpensive and easy to manufacture.

SUMMARY OF THE INVENTION

The apparatus of the present invention has been developed in response to the present state of the art, and in particular, in response to the problems and needs in the art that have not yet been fully solved by currently available raised access flooring. Thus, it is an overall objective of the present invention to provide a raised access floor and related methods that remedy the shortcomings of the prior art.

To achieve the foregoing objective, and in accordance with the invention as embodied and broadly described herein in one embodiment, a raised access floor is provided. The raised access floor has a plurality of panels suspended above a support surface by a plurality of pedestals. The panels may be placed such that each corner rests on a pedestal, and each pedestal supports four adjacent corners. The panels may be attached to the pedestals via fasteners such as screws.

Each panel has a top surface and a frame disposed to extend generally around the top surface. The top surface and the frame are flush with each other on the top side to provide a comparatively smooth visible surface. Each panel includes first, second, third, and fourth edge members disposed generally about the periphery of the panel to form the frame. Each panel also has a center member extending parallel to the first and third edge members, and first and second intermediate members that extend parallel to the center member and are disposed between the center member and the first and third edge members, respectively.

The edge members are attached together by four corner members in such a manner that the frame of the panel has a generally rectangular shape, and possibly a square shape. Each corner member has a hole through which one of the screws passes to attach the panel to the associated pedestals.

Each pedestal has a platform with a plurality of retention flanges designed to cooperate with the associated corner members to keep the panels from sliding longitudinally or laterally. The platform also has a hole adjacent to each retention flange to receive the screw. Stringer plates may optionally extend from the panel to attach to optional stringers. The panels may be designed to operate independently of stringers, but stringers may be added for installations in which the loading or grounding conditions are somewhat unusual.

Each pedestal also has a threaded shank and a nut that threadably engages the shank in such a manner that the shank can raise or lower with respect to a stem to adjust the height of the platform above the support surface. The stem is attached to a foot that has a substantial area in contact with the support surface to enhance the stability of the pedestal. The panels are disposed to rest on the platforms of the pedestals and attached to the pedestals via the screws to form a relatively continuous surface that provides easy access to the region between the support surface and the panels.

The majority of the panel is formed of extruded aluminum. The corner members may be cast from aluminum or steel. Each of the first and second edge members has a frame portion and a top surface portion. The frame portions each have an exterior web, an interior web, a top web, and a bottom web, so that each frame portion is configured generally as a box beam. Each frame portion may have a lip that extends outward. Each top surface portion has a horizontal plate that provides a portion of the top surface. The top surface portion also has a plurality of support spars that run longitudinally underneath the horizontal plate to enhance the bending resistance of the top surface portion. Additionally, each top surface portion of the first and second edge members has an attachment feature, which may take the form of a tongue that extends in the lateral direction.

Each of the first and second intermediate members also has a top surface portion. Additionally, each intermediate member has a plurality of support ribs that extend longitudinally underneath the top surface portion. The top surface portion of each intermediate member has a horizontal plate supported by support spars like those of the horizontal plates of the top surface portions of the first and third edge members. Each horizontal plate also has an attachment feature in the form of a groove disposed to receive the tongue of the adjacent edge member. Furthermore, each horizontal plate also has a tongue disposed adjacent to the center member.

Each of the support ribs has a top end adjacent to the top surface and a bottom end displaced from the top surface. A web extends transversely from the top end to the bottom end. The bottom end has an attachment features disposed at the longitudinal extents thereof. Each of the attachment features may take the form of a tab that can be used to couple the bottom end to the adjacent second or fourth edge member.

Like the intermediate members, the center member has a top surface portion and a plurality of support ribs and support spars extending longitudinally to structurally support the top surface portion. The top surface portion has a horizontal plate with a pair of grooves shaped to receive the tongues of the intermediate members.

Each of the second and fourth edge members has a frame portion like the frame portions of the first and third edge members. Furthermore, each of the second and fourth edge members has an attachment feature designed to receive the tabs of the adjacent ends of the support ribs. Each attachment feature of the second and fourth edge members may include a top ledge and a bottom ledge between which the corresponding tabs are pressed into engagement.

Each of the corner members has a center portion and first and second extensions that extend from the center portion in directions perpendicular to each other. Each extension is designed to be pressed into engagement within the frame portion of the corresponding edge member. Each extension has an exterior wall, an interior wall, and a top wall that are shaped to lie just within their counterparts of the corresponding frame portion. Each of the center portions has a lip that aligns with the lips of the adjacent frame portions.

As mentioned previously, the ends of the support ribs are pressed into engagement with the opposing ledges of the second and fourth edge members. The top ledges may each have an inward bevel and an outward bevel; the outward bevel facilitates insertion of the tab between the top and bottom ledges. The tab is defined by a slot formed in the end of the support rib. The tab is compressed between the top and bottom ledges. The interaction of the tab with the top and bottom ledges serves to reduce bowing of the top surface by aligning the support ribs with each other.

The panel may be easily manufactured in a variety of ways. For example, the edge members, the intermediate members, and the center member may all be extruded from aluminum or an alloy thereof. The corner members may be cast from aluminum, steel, or the like. The slots may then be milled in the bottom end of each support rib, with care to ensure that the slots are disposed an equal distance from the bottom surface of each support rib.

According to one assembly method, the laterally oriented extensions of the corner members are first pressed laterally into engagement with the frame portions of the second and fourth edge members. The first and third edge members, the first and second intermediate members, and the center member are then pressed laterally together so that the tongues of the top surface portions are inserted into the grooves of the top surface portions. Then, the corner members and the attached second and fourth edge members are pressed longitudinally against the ends of the first and third edge members, the first and second intermediate members, and the center member. The longitudinally oriented extensions are thereby pressed into engagement with the frame portions of the first and third edge members. Additionally, the tabs of the support ribs are pressed into engagement between the ledges of the second and fourth edge members.

The panel is thus pressed together in a manner that resists disassembly under loading. The frame and the support ribs cooperate to resist deflection of the panel without requiring the panel to rest on stringers. Although welding may, if desired, be applied in addition to the press fits, welding is not required.

According to one alternative embodiment of the invention, one quadrant of the panel may be removed to provide an open area through which conduits, electrical wiring, or the like may pass. For example, the third and fourth edge members may be cut in half (or fabricated to half their nominal length), the second intermediate member may be cut in half, and the adjacent quarter of the center member may be removed to leave the open area defining one quadrant of the panel.

No corner member is present within the open area. Consequently, a lateral coupling may be attached to the frame portions of the first and third edge members to ensure that the panel stays together without the press fit of the missing corner member. The lateral coupling may have curved ends attached to the frame portions via fasteners such as screws. Optionally, a longitudinal coupling may be attached to the center of the lateral coupling and to the frame portion of the fourth edge member. The longitudinal coupling may also have curved ends attached to the lateral coupling and to the frame portion via screws. Thus, the remaining portions of the panel generally retain their load bearing capacity despite the removal of the panel quadrant.

Furthermore, panels may easily be constructed at different sizes. For example, the intermediate members may be removed, or intermediate members may be added, to alter the lateral dimension of the panel. The second and fourth edge members are then simply lengthened or shortened accordingly. Alternatively, the first and second edge members, the intermediate members, and the center member may all be lengthened or shortened to alter the longitudinal dimension of the panel.

According to another alternative embodiment, the top surface of the panel may be covered by a cover plate. The cover plate may be formed of vinyl, a carbon composite, or the like. The cover plate may be attached to the top surface by an adhesive. If desired, the cover plate and the adhesive may be electrically conductive to enable the panel to act as a grounding surface to dissipate static electricity and the like. A plurality of perforations extend through the cover plate and the top surface to permit air to flow vertically through the panel.

Through the use of the raised access floor and related methods presented herein, the strength-to-weight ratio, ease of use, and ease of installation of raised access floors may be greatly enhanced. These and other features and advantages of the present invention will become more fully apparent from the following description and appended claims, or may be learned by the practice of the invention as set forth hereinafter.

BRIEF DESCRIPTION OF THE DRAWINGS

In order that the manner in which the above-recited and other features and advantages of the invention are obtained will be readily understood, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which:

FIG. 5 is a perspective view of the underside of a panel that may be used in conjunction with the pedestals of FIG. 1 according to one alternative embodiment of the invention, to provide pass-through of conduits or the like.

DETAILED DESCRIPTION OF THE PREFERRED EMBODIMENTS

The presently preferred embodiments of the present invention will be best understood by reference to the drawings, wherein like parts are designated by like numerals throughout. It will be readily understood that the components of the present invention, as generally described and illustrated in the figures herein, could be arranged and designed in a wide variety of different configurations. Thus, the following more detailed description of the embodiments of the apparatus, system, and method of the present invention, as represented in FIGS. 1 through 6, is not intended to limit the scope of the invention, as claimed, but is merely representative of presently preferred embodiments of the invention.

For this application, the phrases "connected to," "coupled to," and "in communication with" refer to any form of interaction between two or more entities, including mechanical, electrical, magnetic, electromagnetic, and thermal interaction. The phrase "attached to" refers to a form of mechanical coupling that restricts relative translation or rotation between the attached objects. The phrases "pivotally attached to" and "slidably attached to" refer to forms of mechanical coupling that permit relative rotation or relative translation, respectively, while restricting other relative motion.

The phrase "attached directly to" refers to a form of attachment by which the attached items are either in direct contact, or are only separated by a single fastener, adhesive, or other attachment mechanism. The term "abutting" refers to items that are in direct physical contact with each other, although the items may not be attached together. The terms "integrally formed" refer to a body that is manufactured unitarily, i.e., as a single piece, without requiring the assembly of multiple pieces. Multiple parts may be integrally formed with each other if they are formed from a single workpiece.

Figure 1:
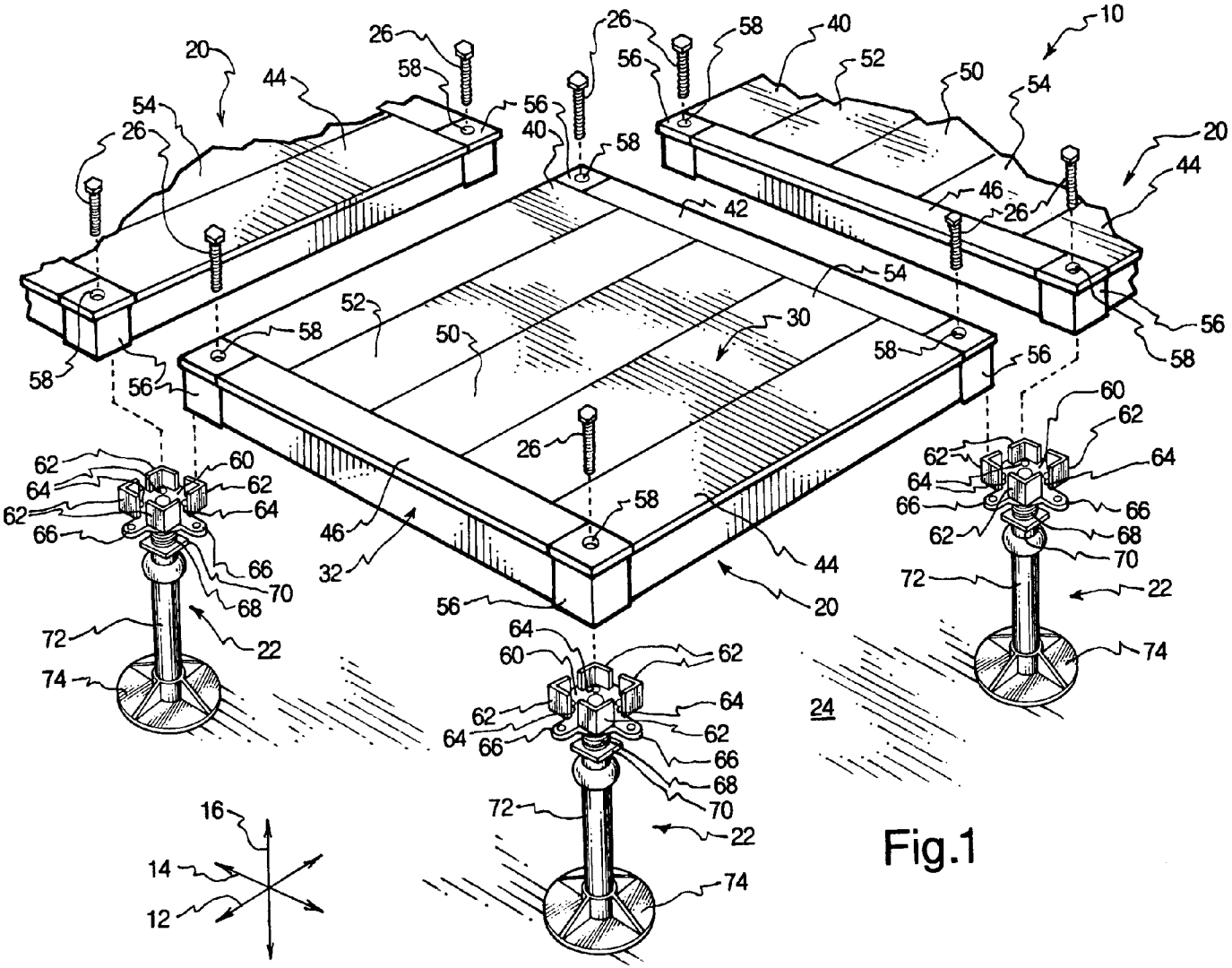
FIG. 1 is an exploded, perspective view of a portion of a raised access floor including a plurality of panels elevated above a support surface via a plurality of pedestals.

Referring to FIG. 1, a perspective view illustrates a portion of a raised access floor 10 according to one embodiment of the invention. The raised access floor 10, or floor 10, has a longitudinal direction 12, a lateral direction 14, and a transverse direction 16. As shown, the floor 10 has a plurality of panels 20 that rest on a plurality of pedestals 22 to form a substantially continuous surface. The pedestals 22 suspend the panels 20 over a support surface 24, which may be a concrete floor or the like. Screws 26 may be used to attach the panels 20 to the pedestals 22.

As shown, each panel 20 has a top surface 30 and a frame 32. The top surface 30 is disposed generally horizontally. The top surface 30 may be exposed, or may be covered by a cover plate, as will be shown and described subsequently. The top surface 30 is substantially continuous, i.e., the top surface 30 has no holes, slots or discontinuities. Such discontinuities may be present in alternative embodiments of the invention, as will be set forth below.

The frame 32 extends around the periphery of the top surface 30 and terminates flush with the top surface 30 to provide a relatively smooth visible surface of the panel 20. As shown, the frame 32, and hence the panel 20, has a generally rectangular, or more specifically, square shape. The panel 20 may be made in standard sizes such as two feet by two feet for flooring made according to imperial measurements, or six hundred millimeters by six hundred millimeters for access flooring made according to metric measurements.

The panel 20 includes a number of components that form the top surface 30 and the frame 32. The components may be formed of extruded aluminum, or an alloy thereof, to provide a relatively high strength-to-weight ratio for the panel 20. These components will be set forth below. However, the invention is not limited to the use of extrusion or aluminum. Other manufacturing materials and/or methods may be used within the scope of the invention. In this application, use of the phrase "formed of extruded aluminum" does not preclude the use of other operations in addition to extrusion to form the member.

In the embodiment illustrated in FIG. 1, the panel 20 includes a first edge member 40, a second edge member 42 perpendicular to the first edge member 40, a third edge member 44 parallel to the first edge member 40, and a fourth edge member 46 parallel to the second edge member 42. Additionally, the panel 20 includes a center member 50 extending generally parallel to the first and third edge members 40, 44. A first intermediate member 52 is disposed between the center member 50 and the first edge member 40, and a second intermediate member 54 is disposed between the center member 50 and the third edge member 44. The intermediate members 52, 54 extend generally parallel to the first and third edge members 40, 44 and the center member 50.

The edge members 40, 42, 44, 46, the center member 50, and the intermediate members 52, 54 may each be formed by extruding aluminum to provide the desired shape. Fabrication and assembly of multiple pieces enables parts to be formed with greater accuracy because extrusion of larger pieces results in correspondingly looser tolerances. The manner in which the edge members 40, 42, 44, 46, the center member 50, and the intermediate members 52, 54 are assembled will be described in greater detail subsequently.

The panel 20 also includes four corner members 56 attached to the edge members 40, 42, 44, 46 to form the frame 32 by attaching the edge members 40, 42, 44, 46 together. Each corner member 56 has a hole 58 designed to receive one of the screws 26. Each hole 58 may have a countersunk shape or the like to enable the head of the screw 26 to lie flush with the top surface 30. The corner members 56 may be cast from aluminum or steel rather than extruded.

Each of the pedestals 22 has a platform 60 supported at the desired height above the support surface 24. A plurality of retention flanges 62 extends upward from each of the platforms 60. Each retention flange 62 may have a generally right-angled shape. Each of the corner members 56 has a downward-facing opening shaped to fit around the corresponding retention flange 62. Hence, the retention flange 62 guides the corner member 56 into its proper assembled position with respect to the platform 60. The retention flange 62 then generally prevents relative motion between the corner member 56 and the pedestal 22 when the panel 20 and the pedestal 22 are assembled.

Each platform 60 has a hole 64 disposed adjacent to each of the retention flanges 62 to receive the associated screw 26. The holes 64 may be threaded, or a separate nut or other fastening device (not shown) may be used to retain the threaded end of each screw 26.

Each pedestal 22 may optionally have four stringer plates 66 disposed below the elevation of the platform 60 to receive optional stringers (not shown). The stringers may not be required in typical installations of the raised access floor 10, but they may be installed in situations in which unique loading and/or grounding requirements are present.

Each platform 60 is supported by a shank 68 with a threaded configuration. A nut 70 threadably engages the shank 68 to help control the elevation of the platform 60. The shank 68 is threadably retained by a stem 72 in such a manner that the elevation of the platform 60 over the support surface 24 can be adjusted. The pedestals 22 may be individually adjusted to ensure that the panels 20 cooperate to form a flat, relatively level surface.

Each stem 72 is supported by a foot 74 with a size selected to ensure that the pedestal 22 is able to remain upright when the floor 10 is loaded. The foot 74 may be disposed generally perpendicular to the stem 72. The pedestals 22 may generally be made of aluminum, steel, or the like.

Figure 2:
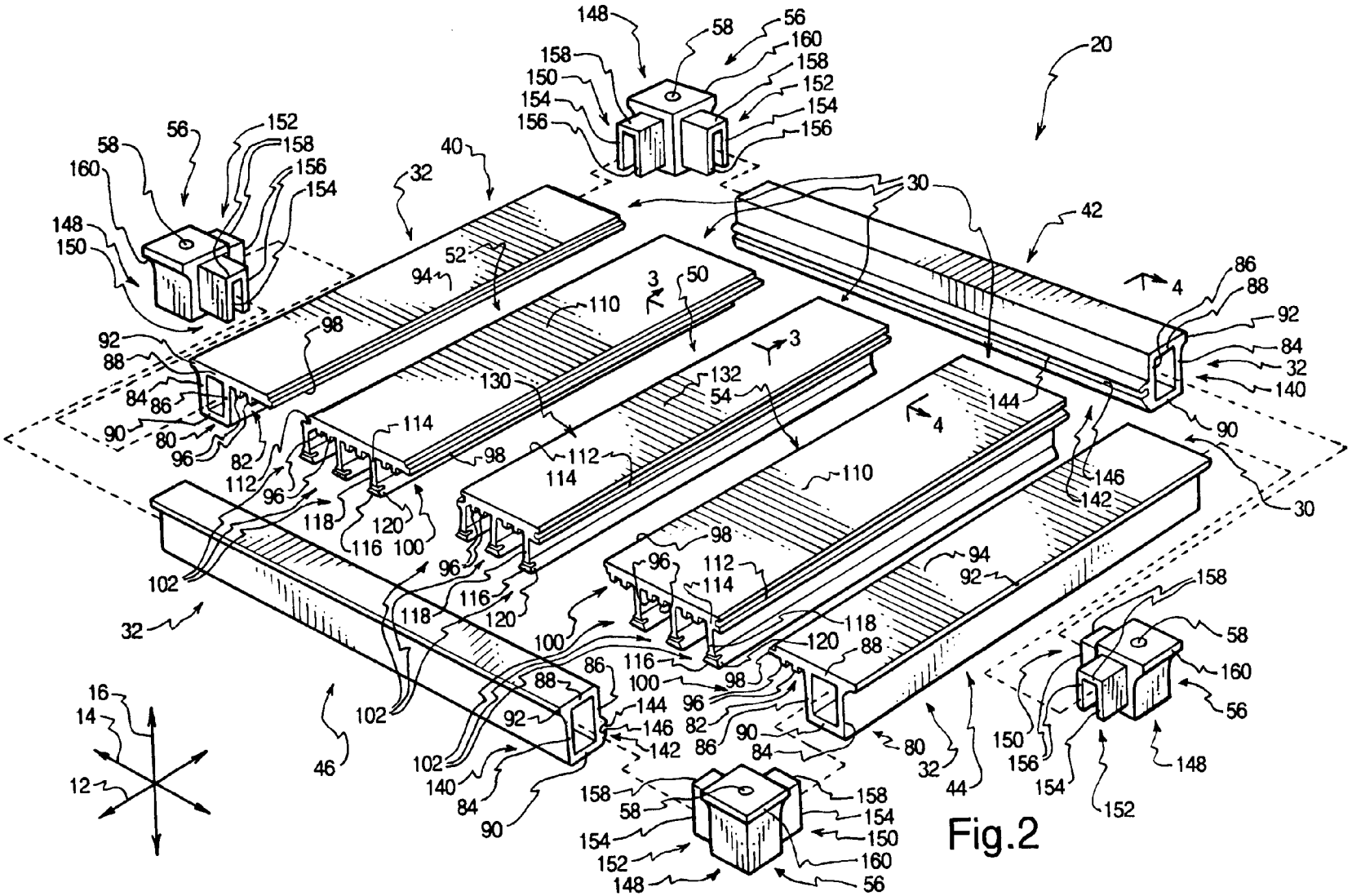
FIG. 2 is an exploded, perspective view of one of the panels of the raised access floor of FIG. 1.
Figure 3:
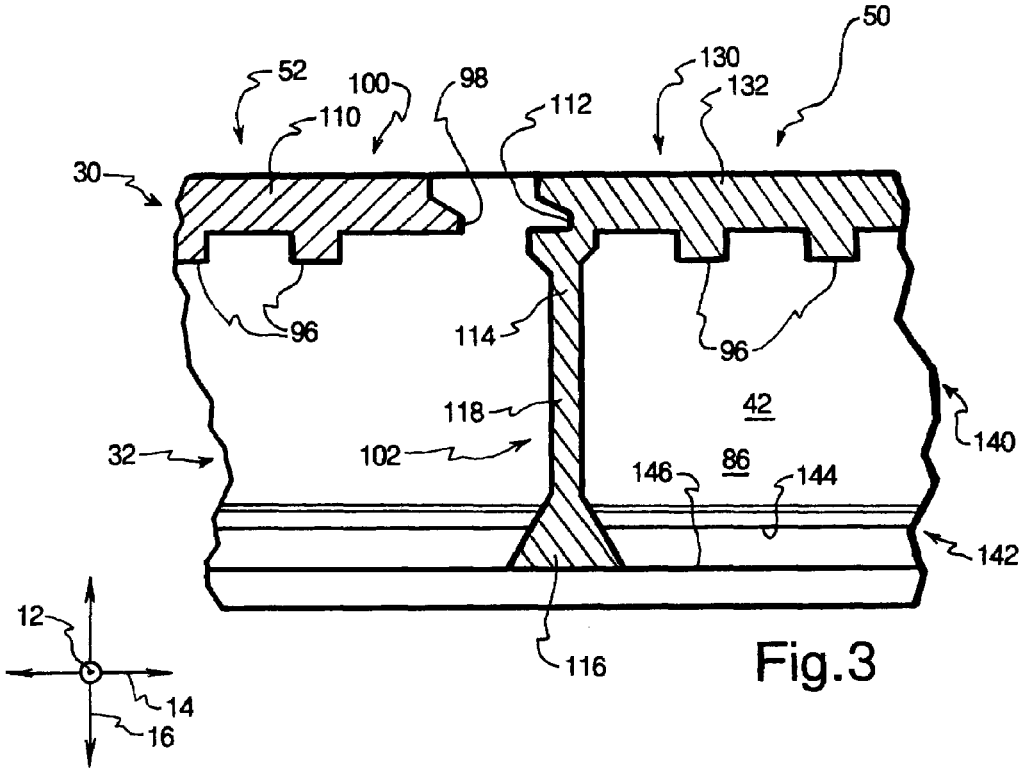
FIG. 3 is a side elevation, exploded section view of a portion of the first intermediate member and the center member of the panel, taken along line 3-3 of FIG. 2 to show assembly of the corresponding tongue-and-groove attachment features.
Figure 4:
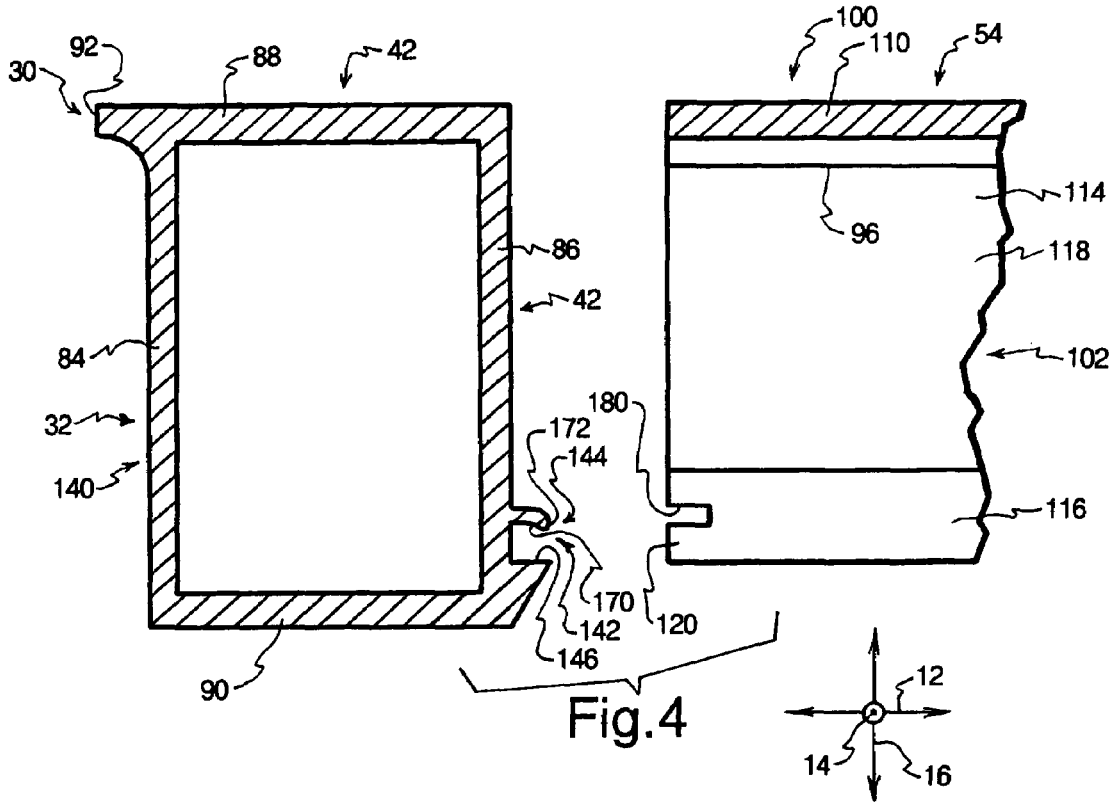
FIG. 4 is a side elevation, exploded section view of the second edge member and a portion of the second intermediate member, taken along line 4-4 of FIG. 2 to show assembly of the tabs of the support ribs with the opposing ledges of the second and fourth edge members.

As follows, FIGS. 2 through 4 provide various exploded views to further illustrate the configuration and assembly of the panel 20. A panel according to one alternative embodiment of the invention will be shown and described in connection with FIG. 5, and a panel according to another alternative embodiment will be shown and described in connection with FIG. 6.

Referring to FIG. 2, an exploded, perspective view illustrates the panel 20 in isolation. As shown, each of the first and third edge members 40, 44 has a frame portion 80 and a top surface portion 82. The frame portion 80 may have a "box beam configuration." More precisely, the frame portion 80 may have an exterior web 84, an interior web 86, a top web 88, and a bottom web 90 that are arranged in rectangular fashion to provide a hollow, rectangular interior. The top web 88 may be generally coplanar with the top surface portion 82, and the bottom web 90 may be displaced from the top web 88, for example, by a distance of about three inches. The displacement between the top and bottom webs 88, 90 removes material from the neutral axis of the frame portion 80, thereby creating a structure that effectively resists bending.

As shown, the frame portion 80 of each of the first and third edge members 40, 44 also has a lip 92 extending generally in the lateral direction, coplanar with the top surface 30. The lip 92 is sufficiently short to avoid forming a significant weak point in the structure of the panel 20. The lip 92 may, however, be sufficiently long that some or all of the lip 92 can be ground, milled, or otherwise removed to reduce the lateral dimension of the panel 20 from twenty-four inches to six-hundred millimeters. Thus, the imperial and metric panel designs and assembly procedures may be identical, except for the added step of removing a small amount of material to provide the metric size without compromising the strength of the panel 20.

The top surface portion 82 of each of the first and third edge members 40, 44 has a horizontal plate 94 that lies generally coplanar with the top web 88 and the lip 92. The top surface portion 82 also has a plurality of support spars 96 that extend in the longitudinal direction 12 to efficiently add thickness, and hence, bending resistance, to the top surface portion 82. The horizontal plate 94 has an attachment feature designed to facilitate coupling of the first and third edge members 40, 44 to the first and second intermediate members 52, 54, respectively. The attachment feature may take the form of a tongue 98 extending in the lateral direction 14. The tongue 98 will be shown in greater detail in connection with FIG. 3.

Each of the first and second intermediate members 52, 54 has a top surface portion 100 and a plurality of support ribs 102 extending in the longitudinal direction 12, adjacent to an underside of the top surface portion 100 to support the top surface portion 100. Each top surface portion 100 has a horizontal plate 110 that can be aligned with and attached to the horizontal plate 94 of the adjacent first and third edge members 40, 44 via an attachment feature, which may take the form of a groove 102 shaped to receive the tongue 98. Additionally, each top surface portion 100 has a tongue 98, like the tongues 98 of the horizontal plates 94 of the first and third edge members 40, 44, extending toward the center member 50 for attachment thereto.

As shown, each of the support ribs 102 has a configuration that provides considerable bending support to the corresponding top surface 100 of the first and second intermediate members 52, 54. More precisely, each of the support ribs 102 has a top end 114 adjacent to the top surface portion 100 and a bottom end 116 displaced from the top surface portion 100. Each support rib 102 has a web 118 that extends generally transversely (e.g., vertically), between the top and bottom ends 114, 116.

The bottom end 116 of each support rib 102 is larger in the lateral direction 14 than the corresponding top end 114. Thus, the bottom end 116 provides the support rib 102 with a shape that provides considerable mass displaced from the neutral bending axis to enhance bending resistance in a manner similar to that of an I-beam. The bottom end 116 may have a generally inverted triangular shape that facilitates airflow in the transverse direction 16 for embodiments having an air-permeable top surface. The inverted triangular shape provides reduced airflow resistance, and also avoids creating a horizontal ledge upon which dust can collect.

Each support rib 102 also has an attachment feature disposed at either longitudinal end thereof. In the embodiment of FIGS. 1 and 2, the attachment features take the form of tabs 120 that can be pressed into engagement with the second and fourth edge members 42, 46 in a manner that will be shown and described in greater detail hereafter. In this application, the terms "press into engagement," "press fit" and "interference fit" are interchangeable. The term "pressed into lengthwise engagement" refers to a member that is press fit along its length, or along its longer axis.

The center member 50 similarly has a top surface portion 130 and a plurality of support ribs 102 that support the top surface portion 130. The top surface portion 130 has a horizontal plate 132 designed to be coupled to the horizontal plates 94, 110 of the first and third edge members 40, 44 and the first and second intermediate members 52, 54. More precisely the horizontal plate 132 of the center member 50 has grooves 112 into which the tongues 98 of the first and third edge members 40, 44 or the first and second intermediate members 52, 54 can be inserted. The support ribs 102 may be substantially the same as described in connection with the intermediate members 52, 54.

When the first and third edge members 40, 44, the first and second intermediate members 52, 54, and the center member 50 are urged together along the lateral direction 14, the tongues 98 enter the grooves 112 shown adjacent to them in FIG. 2. The edges of the horizontal plates 94, 110, 132 are aligned by the interaction of the tongues 98 and grooves 112. Thus, the top surface portions 82, 100, 130 are coupled together to form the comparatively smooth top surface 30 of the panel 20.

The second and fourth edge members 42, 46 are disposed perpendicular to the first and third edge members 40, 44, the first and second intermediate members 52, 54, and the center member 50. Each of the second and fourth edge members 42, 46 has a frame portion 140 similar to the frame portions 80 of the first and third edge members 40, 44. Each frame portion 140 thus has an exterior web 84, an interior web 86, a top web 88, and a bottom web 90 to provide a box beam type configuration. Additionally, each frame portion 140 has a lip 92 extending in the longitudinal direction 12.

Each of the second and fourth edge members 42, 46 also has an attachment feature 142 designed to be coupled to an end of the support ribs 102, or more precisely, to the tabs 120 adjacent to the second or fourth edge member 42, 46. Each attachment feature 142 includes a top ledge 144 and a bottom ledge 146 that face toward each other with a spacing that permits the corresponding tabs 120 to be pressed in the longitudinal direction 12, into engagement between the top and bottom ledges 144, 146 and retained securely by the top and bottom ledges 144, 146. The engagement of the attachment feature 142 of the second edge member 42 with one corresponding tab 120 will be shown and described in greater detail with reference to FIG. 4.

As illustrated, each of the corner members 56 has a center portion 148, a first extension 150, and a second extension 152. The first and second extensions 150, 152 extend generally perpendicular to each other. The first and second extensions 150, 152 are shaped to be pressed into engagement within the hollow interior spaces of the frame portions 80, 140 of the edge members 40, 42, 44, 46.

More precisely, each extension 150 or 152 has an exterior wall 154, an interior wall 156, and a top wall 158. The exterior and interior walls 154, 156 are spaced apart such that the exterior and interior walls 154, 156 lie within and adjacent to the exterior and interior webs 84, 86 of the corresponding frame portion 80 or 140. The exterior and interior walls 154, 156 press outward against the exterior and interior webs 84, 86 to retain the extension 150 or 152 securely within the corresponding frame portion 80 or 140. Similarly, the top wall 158 lies within and adjacent to the top web 88 of the associated frame portion 80 or 140 in such a manner that the top wall 158 presses against the top web 88.

If desired, a bottom wall (not shown) may also be added to each extension 150, 152 to enhance engagement with the bottom web 90 of the corresponding frame portion 80 or 140. However, it may be beneficial to omit the bottom wall to facilitate formation of the corner members 56 via casting or other simple operations. Furthermore, if desired, the interior surfaces of the webs 84, 86, 88 may have beads, ridges, or other features extending along their length to enhance the integrity of the press fit via deformation of the bead, ridge, or other feature.

The center portion 148 of each of the corner member 56 includes a lip 160 that extends outward in the longitudinal and lateral directions 12, 14 in alignment with the lips 92 of the adjacent frame portions 80, 140. Thus, the lips 160, 92 form a relatively continuous border surrounding the frame 32. In order to convert the panel 20 to a metric size, the lips 92, 140 may all be ground, milled, or otherwise reduced in size in a relatively uniform manner.

As mentioned previously, the corner members 56 may be formed through a method such as die casting. Hence, text, logos, serial numbers, lot information, or the like may be printed on the corner members 56.

If desired, the height of the center portions 148 may be modified to enable the panel 20 to have any desired height above the pedestals 22. For example, the nominal height (i.e., transverse dimension) of the edge members 40, 42, 44, 46 may be three inches. However, if the panel 20 is to be used in conjunction with panels that are only two inches high, such as those that may be present within a pre-existing raised access floor, the center portions 148 of the corner members 56 may be made with a height of only two inches, or milled or ground to a height of two inches, so that the top surface 30 lies flush with the top surfaces of the old panels. Since little bending stress is carried by the corner members 56, altering the height of the center portions 148 will probably have little effect on the strength of the panel 20. The heights of the first and second extensions 150, 152 may be similarly altered, or may remain unchanged.

Manufacture and assembly of the panel 20 may be performed in a variety of ways. As mentioned previously, the edge members 40, 42, 44, 46, the center member 50, and the intermediate members 52, 54 may all be extruded from aluminum or an alloy thereof. The limited lateral and transverse dimensions of the edge members 40, 42, 44, 46, the center member 50, and the intermediate members 52, 54 permit smaller, less expensive, and more accurate extrusion equipment to be used to form them. Milling, grinding, or other operations may be used to form the tabs 120 in the ends of the support ribs 102 of the center member 50 and the intermediate members 52, 54. The corner members 56 may be die cast from aluminum or steel.

The corner members 56 may first be attached to the second and fourth edge members 42, 46 by inserting the corresponding extensions 150, 152 into the hollow interior regions of the frame portions 140 and then pressing the corner members 56 and the second and fourth edge members 42, 46 together along the lateral direction 14. The pressure may be applied in a horizontal pneumatic or hydraulic press, or the like, to provide a relatively secure press fit. The first and third edge members 40, 44, the center member 50, and the intermediate members 52, 54 may also be urged together along the lateral direction 14, although the tongues 98 and grooves 112 need not necessarily provide any type of interference fit. The top surface 30 is thereby assembled.

Then, the second and fourth edge members 42, 46, with the attached corner members 56, may be pressed into engagement with the first and third edge members 40, 44, the center member 50, and the intermediate members 52, 54 along the longitudinal direction 12. This may also be performed through the use of a horizontal press. The edge members 40, 42, 44, 46, the intermediate members 52, 54, and the center member 50 may all be laid upside down in the press so that they will be properly aligned with each other in the transverse direction 16. If desired, pressure may be applied in the transverse direction 16 to the bottom ends 116 of the support ribs 102 to help reduce bowing of the intermediate members 52, 54 and the center member 50 during assembly.

As pressure is applied in the longitudinal direction 12, the exposed extensions 150, 152 of the corner members 56 are pressed into the hollow interior spaces of the frame portions 80 of the first and third edge members 40, 44. The extensions 150, 152 are pressed into secure engagement with the frame portions 80 to complete assembly of the frame 32. Simultaneously, the tabs 120 of the support ribs 102 are pressed into engagement with the attachment features 142 of the second and fourth edge members 42, 46 to complete assembly of the panel 20.

Referring to FIG. 3, a side elevation, exploded section view illustrates a portion of the first intermediate member 52, the center member 50, and the second edge member 42. As shown, the tongue 98 of the first intermediate member 52 is aligned with the adjacent groove 112 of the center member 50. When the first intermediate member 52 and the center member 50 are urged together along the lateral direction 14, the tongue 98 will slide into the groove 112 to ensure that the horizontal plates 110, 132 align properly with each other.

Upon assembly, the tongue 98 and groove 112 are disposed directly over one of the support ribs 102. Hence, downward pressure applied to the top surface 30 will not cause the tongue 98 to slide out of the groove 112. Rather, friction of the tongue 98 against the groove 112 increases in response to the downward pressure to keep the tongue 98 within the groove 112.

Referring to FIG. 4, a side elevation, exploded section view illustrates the second edge member 42 and a portion of the second intermediate member 54. As shown, the second intermediate member 54 is aligned with the second edge member 42 in such a manner that the horizontal plate 110 of the second intermediate member 54 is flush with the top web 88 of the second edge member 42. The tab 120 is also aligned with the gap between the upper and lower ledges 144, 146 so that, when the second intermediate member 54 is pressed longitudinally against the second edge member 42, the tab 120 is inserted between the ledges 144, 146.

As shown, the lower ledge 146 may simply provide a horizontal surface. However, the upper ledge 144 may have an inward bevel 170 and an outward bevel 172 that facilitate insertion and retention of the tab 120 between the ledges 144, 146. The outward bevel 172 may serve to guide the tab 120 into the gap between the upper and lower ledges 144, 146.

Each tab 120 may be defined by forming a slot 180 toward the bottom end 116 of the corresponding support rib 102. The slot 180 may be formed by milling, grinding, electric discharge, or other known methods. During assembly, the top ledge 144 is inserted into the slot 180.

The slot 180 may be formed in such a manner that the height of the tab 120 is at a pre-established value for each of the support ribs 102 so that the tabs 120 will all be sized properly for engagement between the ledges 144, 146. Hence, each slot 180 is formed with reference to the edge of the bottom end 116 of the support rib 102 in which it is formed, so that bowing or other manufacturing defects in the intermediate members 52, 54 or the center member 50 will not impair retention of the support ribs 102 by the second and fourth edge members 42, 46. After assembly, the engagement of the tabs 120 between the ledges 144, 146 helps to reduce any bowing effects present in the center member 50 or the intermediate members 52, 54. Thus, the top surface 30 is kept relatively flat.

The use of the press fit, or pressed engagement, between the tab 120 and the ledges 144, 146 is also advantageous because no welding is required. Indeed, the entire panel 20 may be produced substantially without welding. If desired, welding may be used to reinforce retention of the support ribs 102 by the second and fourth edge members. Other attachment methods and devices, such as mechanical fasteners, adhesives, and the like, may be used in addition to or in the alternative to press fitting.

The components of the panel 20 may relatively easily be modified to permit removal of a portion of the panel 20. This may be accomplished substantially without losing the structural strength of the panel 20. One example of such modification will be shown and described in connection with FIG. 5, as follows.

Figure 5:
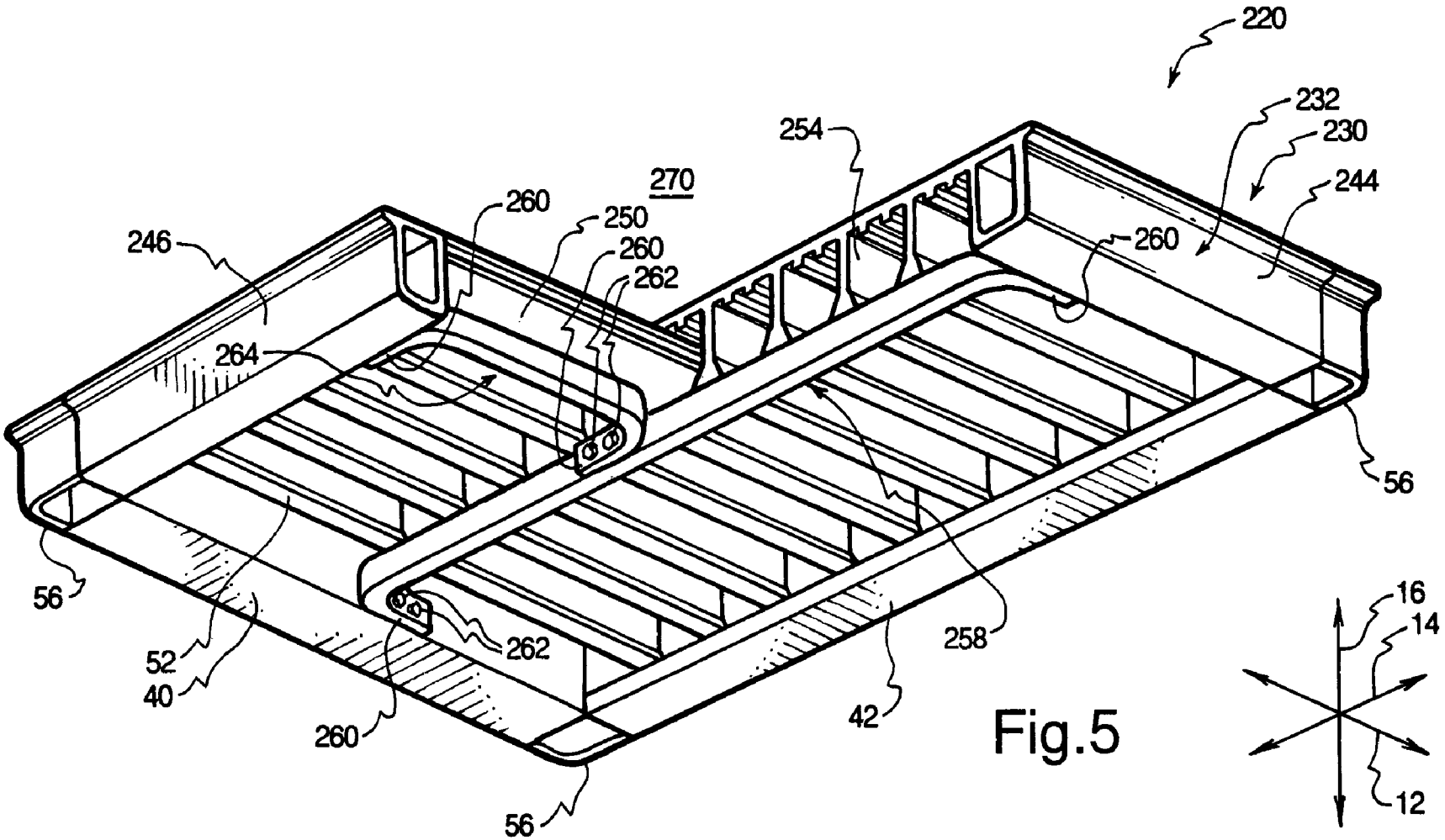

Referring to FIG. 5, a perspective view illustrates a panel 220 according to an alternative embodiment of the invention, as viewed from beneath. The panel 220 is similar to the panel 20 except that the panel 220 covers only three quadrants. Thus, the panel 220 may be suitable for areas in which conduits, wiring, machine parts, or the like must pass through the access flooring.

The panel 220 has a top surface 230 and a frame 232, each of which is generally rectangular, or more specifically, square, in shape except for the missing quadrant. The panel 220 has a number of components, including first and second edge members 40, 42, which may be substantially as described above, in connection with the previous embodiment. Additionally, the panel 220 has a third edge member 244 and a fourth edge member 246, each of which may be about half the length of their counterparts from the previous embodiment.

The panel 220 also has a center member 250 like that of the center member 50 of the previous embodiment except that the center member 250 lacks a quadrant corresponding to the open quadrant of the panel 220. The panel 220 has a first, intermediate member 52 like that of the previous embodiment, and a second intermediate member 254, which is about half the length of the second intermediate member 54 of the previous embodiment.

The panel 220 has only three corner members 56. Accordingly, the panel 220 has less press fit attachments to hold the panel 220 together than the panel 20. In order to compensate for this, a lateral coupling 258 may be attached to the first and third edge members 40, 244. The lateral coupling 258 may be an aluminum or steel strip with curved ends 260 that run generally parallel to the first and third edge members 40, 244 to facilitate attachment. A plurality of fasteners, such as screws 262, may be used to attach the curved ends 260 to the first and third edge members 40, 244.

The lateral coupling 258 serves to keep the panel 220 together in the lateral direction 14. If desired, a longitudinal coupling 264 may also be provided to hold the panel 220 together in the longitudinal direction 12. The longitudinal coupling 264 has curved ends 260 that are attached to the central portion of the lateral coupling 258 and to the fourth edge member 246. Fasteners such as screws 262 are again used to provide the attachment.

The lateral coupling 258 and the longitudinal coupling 264 are only two examples of structures that may be used to keep the components of the panel 220 together. In the alternative, no such couplings may be necessary, but the remaining press fits of the panel 220 may be sufficient to keep the panel 220 together under normal loading. The three remaining corner members 56 may be attached to the pedestals 22 via the screws 26 illustrated in FIG. 1; hence, the attachment of the panel 220 is still stable despite the lack of a fourth corner.

An open area 270 of the panel 220 is shown in FIG. 5, and as described above, may comprise a quadrant of the panel 220. However, if desired, an open area of a panel may have any shape and size. For example, the circular, semicircular, triangular, and rectangular shapes may be used.

The open area 270 may also be provided in a variety of ways. For example, certain components, such as the third and fourth edge members 244, 246, the center member 250, and the second intermediate member 254 may be extruded to the full dimensions of their counterparts of the previous embodiment, and subsequently cut to the dimensions illustrated in FIG. 5. Alternatively, shorter extrusions may be fabricated and used.

The modular nature of the panels of the present invention also facilitates production of rectangular panels in a variety of sizes. For example, a panel only one foot wide in the lateral direction 14, and two feet long in the longitudinal direction 12, may be made by omitting the intermediate members 52, 54 of the panel 20 and extruding the second and fourth edge members 42, 46 to an accordingly shorter length. In order to fabricate a panel that is larger than two feet in the lateral direction 14, additional members such as the intermediate members 52, 54 may be added, and the second and fourth edge members 42, 46 may be made accordingly longer. Panels need not necessarily have a center member 50 disposed at the exact center of the panel; rather, asymmetrical designs are contemplated by the present invention.

Alternatively, the first and third edge members 40, 44, the intermediate members 52, 54, and the center member 50 may all be extruded to a shorter length to provide a panel that is two feet in the lateral direction 14, but less than two feet in the longitudinal direction 12. The first and third edge members 40, 44, the intermediate members 52, 54, and the center member 50 may alternatively be made longer to provide a panel with a length longer than two feet. When larger panels are created, care must be taken to either provide intermediate support or to decrease the loading of the panel to account for the increased spacing of the pedestals 22.

Panels may also be made with a variety of surfacing types for different flooring types. Perforations may be included to provide airflow. One example of a panel with vinyl surfacing and perforations will be shown and described in connection with FIG. 6, as follows.

Figure 6:
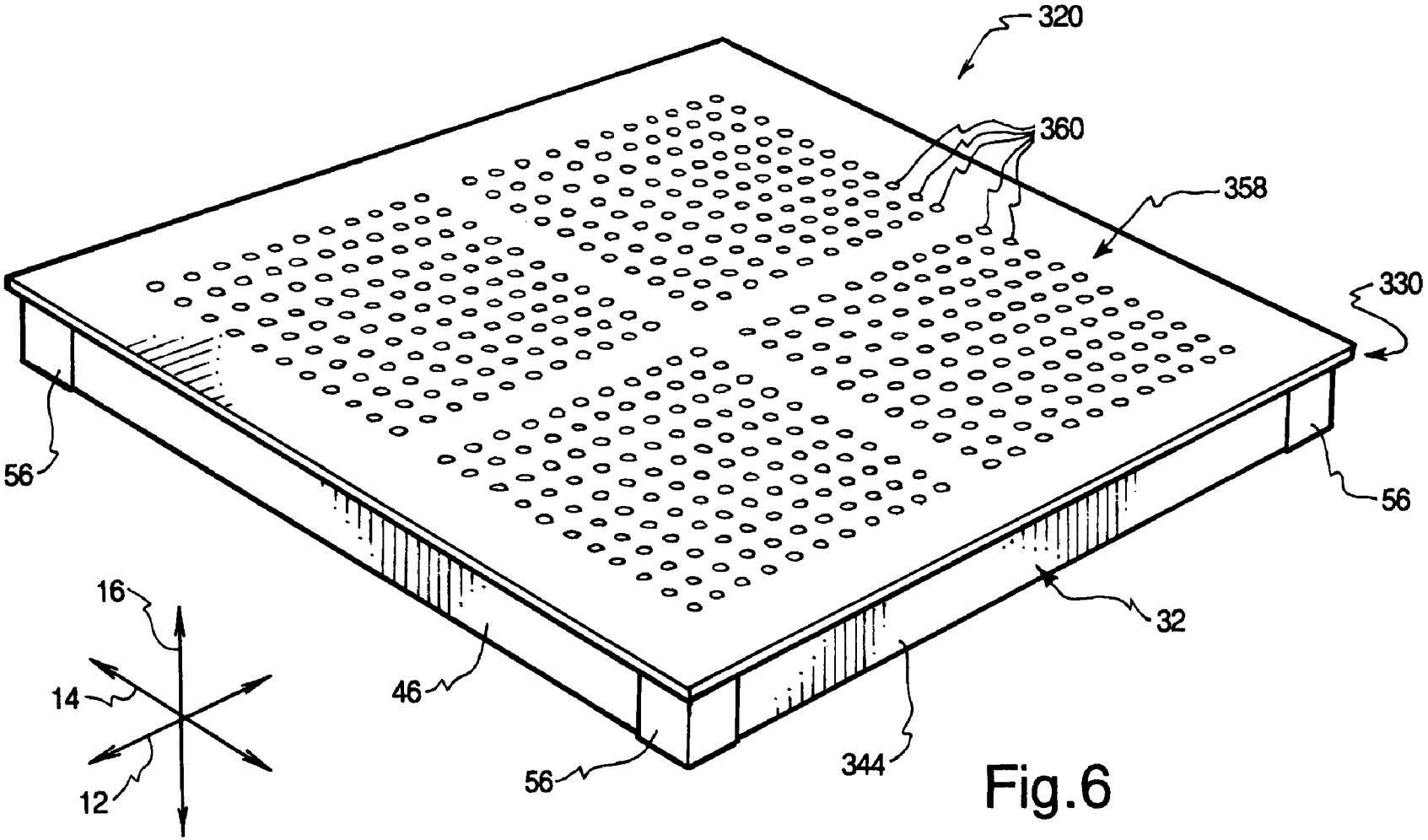
FIG. 6 is a perspective view of a panel according to another alternative embodiment, with a cover plate and a plurality of perforations formed in the cover plate and the top surface to permit airflow through the panel.

Referring to FIG. 6, a perspective view illustrates a panel 320 according to another alternative embodiment of the invention. The panel 320 has a top surface 330 and a frame 32 extending substantially around the top surface 330 in a generally rectangular, or more specifically, square shape. The panel 320 has a plurality of components that are similar to those of the panel 20 of FIGS. 1 through 4. Many of these components are hidden from view in FIG. 6. Some components, such as the fourth edge member 46 and the corner members 56, are identical to their counterparts from FIG. 1. However, the components having top surface portions, such as the third edge member 344, are different from their counterparts from FIG. 1 in that the top surface portions (not visible) are perforated, as will be described subsequently.

The panel 320 includes a cover plate 358 attached to the top surface 330. The cover plate 358 is dimensioned to rest on top of substantially the entire top surface 330 and substantially the entire frame 332; hence, the top surface 330 and the frame 332 may not be visible to a person looking that the panel 320 when installed in a raised access floor. The cover plate 358 may be formed of a polymer such as vinyl, and may thus be used to obtain a specific floor color, reflectivity, texture, or electrical conductivity. The cover plate 358 may be attached to the top surface 330 via an electrically conductive adhesive (not shown) to enable dissipation of electricity, such as static electricity, through the panel 320 via the cover plate 358.

The panel 320 has a plurality of perforations 360 that extend through the cover plate 358 and the top surface 330 to permit airflow in the transverse direction 16 through the panel 320. The perforations 360 may be formed by an automated drill press or the like, which may form the perforations 360 in any desirable pattern. In the alternative to perforations 360 with a circular shape, perforations may have a wide variety of shapes, and may thus form slots (not shown) or other features, depending on the intended use of the panel.

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes that come within the meaning and range of equivalency of the claims are to be embraced within their scope.

The invention claimed is:

1. A panel for a raised access floor, the panel comprising:

a top surface having a generally horizontal orientation;

a hollow frame extending substantially around a periphery of the top surface; and a support rib pressed lengthwise into engagement with opposite portions of the frame to structurally support the top surface, the support rib comprising a top end adjacent to an underside of the top surface; a bottom end displaced from the top surface, and a web extending between the top and bottom ends, wherein the bottom end comprises a thickness perpendicular to the web that is larger than a thickness of the web, wherein the top surface comprises a plurality of substantially parallel top surface portions integrated with a first edge member, a third edge member, and a center member extending parallel to each other, wherein the frame comprises a plurality of frame portions integrated with the first and third edge members and with a second edge member and a fourth edge member, wherein the second and fourth edge members are disposed substantially perpendicular to the first and third edge members, wherein the frame portions of the second and fourth edge members each comprise an exterior web extending substantially perpendicular to the top surface and an interior web substantially parallel to the exterior web, wherein the support rib is pressed lengthwise against the interior webs, wherein the support rib extends generally parallel to the center member, the first edge member, and the third edge member, wherein the second and fourth edge members each comprise a pair of opposing ledges and the bottom end of the support rib comprises a first tab shaped to be pressed into engagement between the ledges of the frame portion of the first edge member and a second tab shaped to be pressed into engagement between the ledges of the frame portion of the second edge member.

2. The panel of claim 1, wherein the support rib is formed of extruded aluminum.

3. The panel of claim 1, wherein the support rib is integral with the center member, wherein the top surface portions are further integrated with a first intermediate member extending between the center member and the first edge member, and a second intermediate member extending between the center member and the third edge member, wherein each of the first and second intermediate members comprises at least one additional support rib pressed into engagement with opposite portions of the frame to structurally support the top surface.

4. The panel of claim 1, further comprising four corner members disposed at junctions of the first, second, third, and fourth edge members to form the frame by attaching the first, second, third, and fourth edge members together.

* * * * *